US005678261A

United States Patent [19]

Han

[11] Patent Number: 5,678,261

[45] Date of Patent: Oct. 21, 1997

[54] CUSHION DEVICE

[76] Inventor: Young Joon Han, 26/1, 1049-4, Sanggye 1-dong Nowon-gu, Seoul 139-201, Rep. of Korea

[21] Appl. No.: 411,654

[22] PCT Filed: Dec. 30, 1993

[86] PCT No.: PCT/KR93/00126

§ 371 Date: Apr. 5, 1995

§ 102(e) Date: Apr. 5, 1995

[87] PCT Pub. No.: WO95/04489

PCT Pub. Date: Feb. 16, 1995

[30] Foreign Application Priority Data

Aug. 10, 1993 [KR] Rep. of Korea ..... 93-15304

[51] Int. Cl.[6] ..... A47C 19/00

[52] U.S. Cl. ..... 5/190; 5/199; 5/110; 5/112

[58] Field of Search ..... 5/190, 199, 191, 5/186.1, 112, 110, 111, 652; 482/27

[56] References Cited

U.S. PATENT DOCUMENTS

| | | | |
|---|---|---|---|
| 74,293 | 2/1868 | Bradley | 5/190 |
| 1,021,772 | 4/1912 | Girotenhuis | 5/190 |
| 1,107,705 | 6/1914 | France | 5/110 |
| 1,329,145 | 1/1920 | Seelig | 5/247 |
| 1,546,145 | 7/1925 | Otewact | 5/199 |
| 2,371,099 | 3/1945 | Goldberg | 5/190 |
| 2,641,777 | 6/1953 | Karashk | 5/199 |
| 3,733,625 | 5/1973 | Platt et al. | 5/191 |
| 3,949,434 | 4/1976 | Anacker | 5/110 |
| 4,136,410 | 1/1979 | Vanderbark et al. | 5/190 |
| 4,523,342 | 6/1985 | Poovey | 5/250 |

FOREIGN PATENT DOCUMENTS

| | | |
|---|---|---|
| 451431 | 5/1968 | Switzerland . |
| 1567157 | 5/1980 | United Kingdom . |

*Primary Examiner*—Alexander Grosz
*Attorney, Agent, or Firm*—Watson, Cole Stevens, Davis, P.L.L.C.

[57] ABSTRACT

The present invention relates to a cushion device utilized for a bed, sofa, chair, or seat for a vehicle. The cushion device comprises an outer supporting member (20) having a shock absorbing space (10) and a cushion plate (30) to be elastically installed on the outer supporting member (20). The cushion device of the present invention comfortably accommodates a human body, and has long life.

19 Claims, 3 Drawing Sheets

FIG. 1
(PRIOR ART)
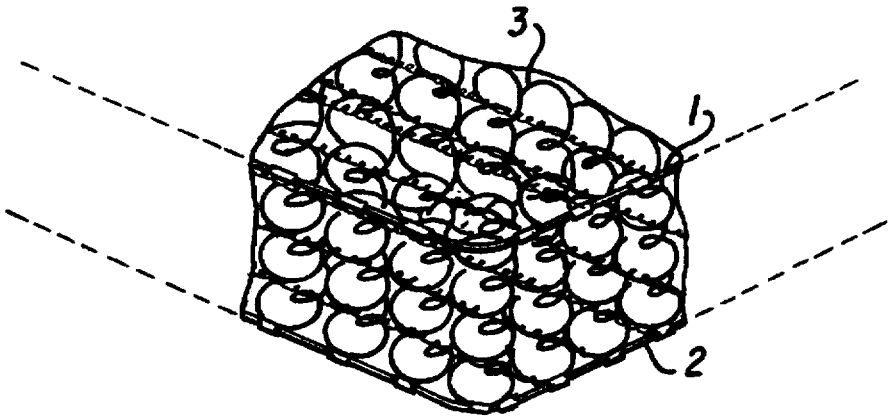
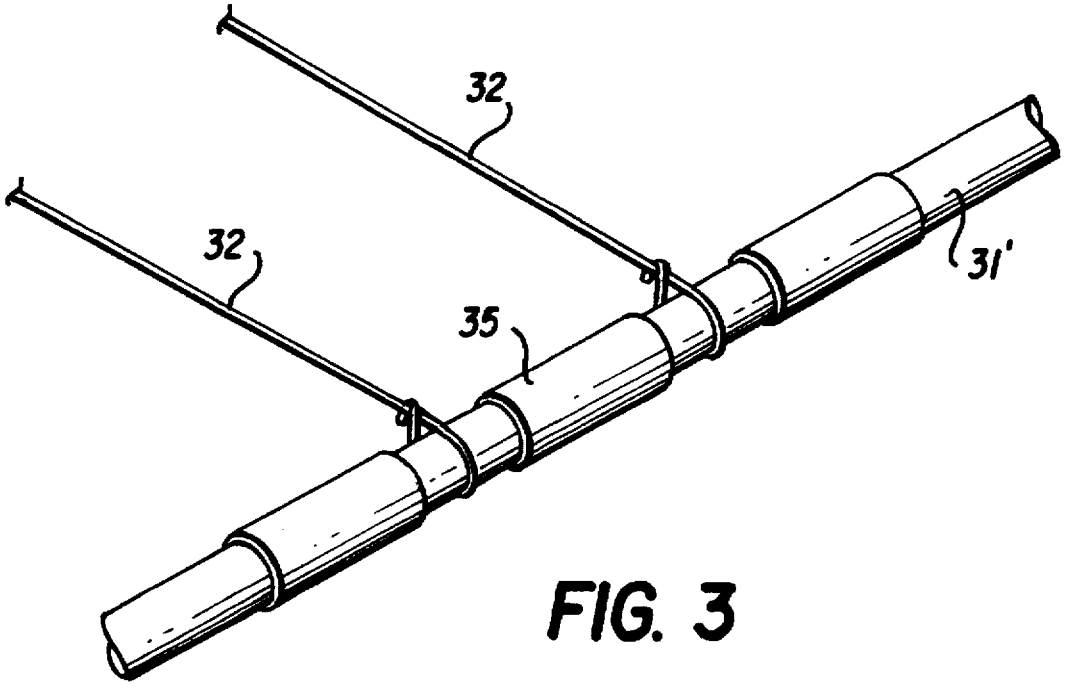
FIG. 3

FIG. 4
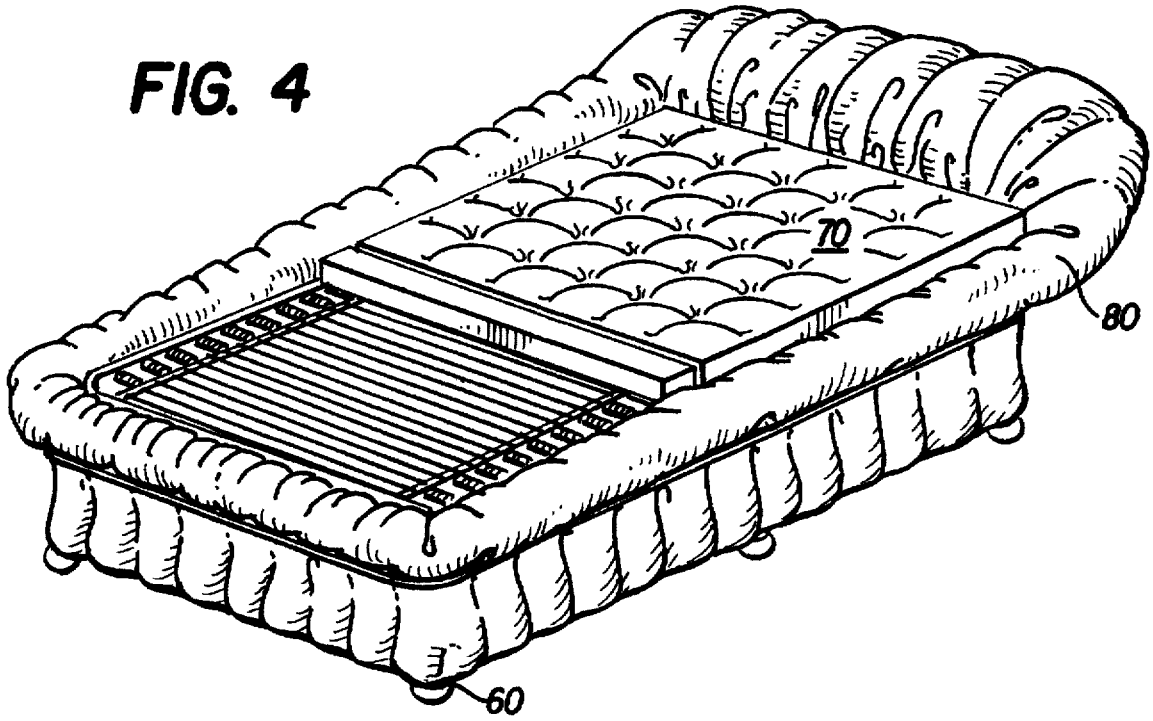
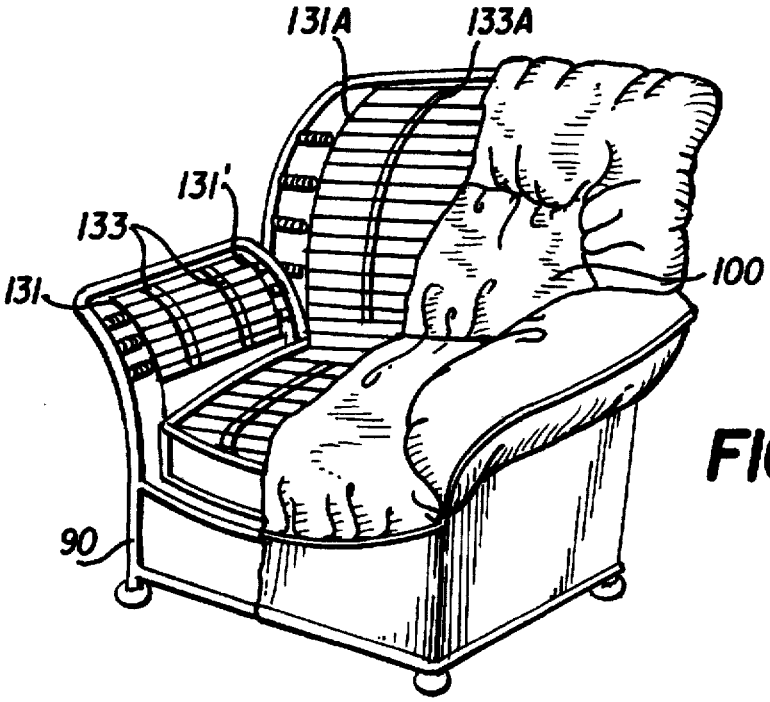
FIG. 5

CUSHION DEVICE

FIELD OF THE INVENTION

The present invention relates to a cushion device utilized for a bed, sofa, chair, or seats for the use of a vehicle, etc., and more particularly relates to a cushion device which is comfortable because it is manufactured by a process based on engineering to accommodate the human body, and has long life.

BACKGROUND ART

Conventional cushion devices have employed sponges. Over time the sponges have a drawback that the elasticity of the sponges is reduced and finally lost because they are under weight beyond their elastic limit. Recently, a cushion device was developed, which has a predetermined area as a network structure connected by steel springs. The conventional cushion device made of the steel springs is shown in FIG. 1, which illustrates a part of the cushion device for a bed. In the conventional device, a plurality of steel springs are connected with one another between an upper frame 1 and a bottom frame 2 in a network arrangement.

However, the conventional device has drawbacks such as having a complex manufacturing process, making noises during cushion movement, and not providing the best comfort, in view of engineering to accommodate the human body due to the degree of different loads against the springs according to each of the bending portions of the human body.

SUMMARY OF THE INVENTION

Therefore, to solve the above problems in the conventional device, it is an object of the present invention to provide a cushion device on which a person feels the best comfort because the cushion was manufactured by a process based on engineering to accommodate the human body.

It is another object of the present invention to provide a cushion device having almost no noises during cushion movement.

It is another object of the present invention to provide a cushion device that is easy to manufacture and has long life relative to prior art sponge cushions.

To accomplish the above objects of the present invention, there is provided a cushion device, the device comprising: an outer supporting member which has a predetermined area and is formed to include a shock absorbing space; and a cushion plate which includes bars located at a predetermined interval inside from the outer supporting member and connected to the outer supporting member by a plurality of elastic springs, and a plurality of steel wires that are installed at regular intervals between the two bars.

BRIEF DESCRIPTION OF THE DRAWINGS

FIG. 1 is a perspective view showing an example of a conventional cushion device.

FIG. 3 is an enlarged perspective view of portion "A" in the device of FIG. 2.

FIG. 4 is a partially cut-away perspective view of a bed with a cushion device according to the present invention.

FIG. 5 is a partially cut-away perspective view of a sofa with a cushion device according to the present invention.

BEST MODE FOR CARRYING OUT THE INVENTION

Figure 2:
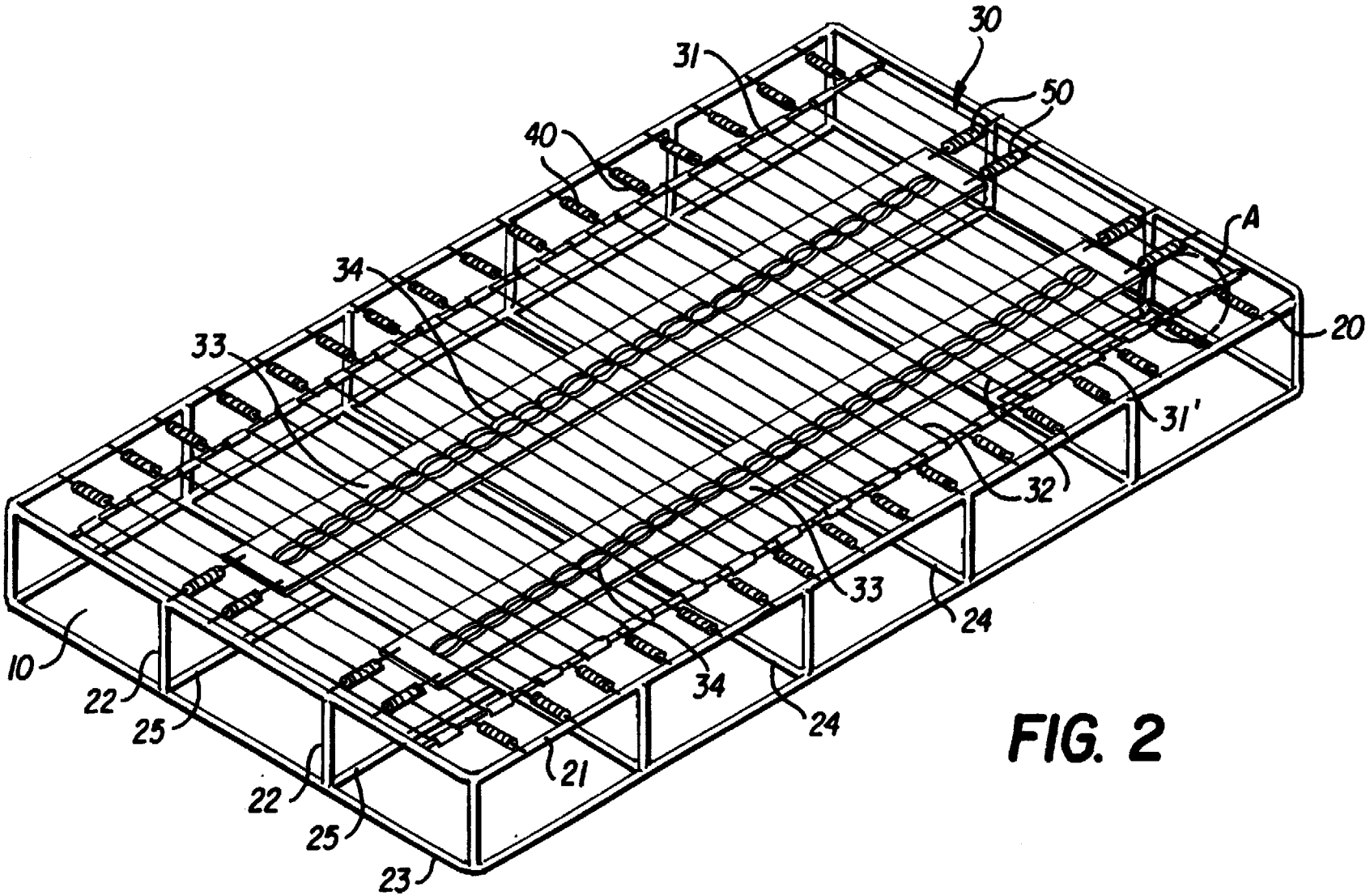
FIG. 2 is a perspective view of a preferred embodiment of a cushion device according to the present invention.

The preferred embodiment of the present invention will be described below with reference to the accompanying drawings.

FIG. 2 is a perspective view of a preferred embodiment of a cushion device for the bed according to the present invention. The cushion device of the present invention comprises an outer supporting member 20 which has a predetermined area and is formed to include a shock absorbing space 10. The outer supporting member 20 preferably has a hollow pipe shape made of steel. The outer supporting member 20 includes a first outer frame 21 with a predetermined area, a plurality of supporting frames 22 which are extended downwards from the first outer flame 21 so as to form the shock absorbing space 10, and a second outer frame 23 which is fixed to the supporting flames 22 and is in a parallel arrangement with the first outer frame 21. A cushion plate 30 is elastically fastened to the first outer frame 21 of the outer supporting member 20 by a plurality of first elastic springs 40.

The cushion plate 30 includes a pair of bars 31, 31' which are fastened to the outer supporting member 20 by a plurality of the first elastic springs 40, and a plurality of steel wires 32 that are installed at regular intervals between the two bars 31, 31'. As also shown in FIG. 2, in the case of a Wide cushion plate, the cushion plate 30 preferably further includes one or more elongated elements 33, which are connected to the outer supporting member 20 by second elastic springs 50. The elongated elements 33 are placed transversely to a plurality of the steel wires 32 and arranged to support them. On the elongated elements 33 strings 34 for tying a plurality of the steel wires 32 are made of nonmetal materials, and preferably made of cotton yams. Here, it is preferred to enhance tensile strength of the second elastic springs 50 rather than that of the first elastic springs 40.

The cushion device of the present invention further includes a plurality of first reinforcing flames 24, being in a parallel arrangement to the steel wires 32 at regular intervals, which are fixed between the outer frames 21, 23 to form the shock absorbing space 10. Between the first reinforcing flames 24 adjacent to the second outer frame 23 and the second outer frame 23, a plurality of second reinforcing frames 25 are preferably installed in a parallel arrangement to the elongated elements 33 in order to prevent the flexing of the outer frames 21, 23 due to the tensility of the elongated elements 33.

FIG. 3 is an enlarged perspective view of portion "A" in the device of FIG. 2. As shown in FIG. 3, after curving around the bar 31', the ends of the steel wires 32 are bent and the inside of the bent portions are fastened to the respective steel wire 32 to form a respective closed loop about the bar 31'. Accordingly, the fastened steel wires are securely maintained in a tied form under the load of the human body. In addition, fixed members 35 are placed between each of the steel wires 32, to prevent the movement of each of the steel wires 32.

FIG. 4 shows a bed with an internal cushion device of FIG. 2. Referring to FIG. 4, the cushion device of the present invention is installed on bed legs 60 and includes, in order, a mat 70 and a sheet cove 80 thereon.

FIG. 5 is a partially cut-away perspective view of a sofa with an internal cushion device according to the present invention. As shown in. FIG. 5, the cushion device of the present invention is installed on sofa legs 90 and include a sheet cover 100 thereon. The cushion device of FIG. 5 also includes curved bars 131, 131' and 131A, as well as elongated elements 133, 133A.

INDUSTRIAL APPLICABILITY

As described above, a cushion device in accordance with the present invention allows a person to sit or lie down comfortably became it provides a nearly equal elasticity to each of the bending portions of the human body when the person lies or sits thereon. Also, the device provides advanced advantages by being noiseless, easy to manufacture, and having long life.

What is claimed is:

1. A cushion device, the device comprising:

an outer supporting member (20), having a predetermined area which is formed to include a shock absorbing space (10);

a cushion plate (30) which includes two bars (31,31') that are located at a predetermined interval inside from said outer supporting member (20) and connected to said outer supporting member (20) by a plurality of elastic springs (40) and a plurality of steel wires (32) that are installed at regular intervals between said two bars; and at least one elongated element (33), each elongated element (33) having two ends, the two ends being connected to said outer supporting member (20) by elastic springs (50), and each elongated element (33) being parallel to a longitudinal axis of the outer supporting member (20) and arranged transversely to said plurality of said steel wires (32) to support said steel wires (32), wherein said plurality of said steel wires (32) are tied by strings (34) made of nonmetal materials on said at least one elongated element (33).

2. The device according to claim 1, wherein the device comprises at least two elongated elements.

3. The device according to claim 1, wherein said outer supporting member (20) comprises a first outer frame (21); a plurality of supporting frames (22), which are extended downwards from said first outer frame (21) so as to form said shock absorbing space (10); and a second outer frame (23), which is fixed to said supporting frames (22) and is in a parallel arrangement with said first outer frame (21).

4. The device according to claim 3, wherein said outer supporting member (20) further comprises a plurality of first reinforcing frames (24), being in a parallel arrangement to said steel wires (32) at regular intervals, which are fixed between said outer frames (21, 23) forming said shock absorbing space (10).

5. A cushion device, the device comprising:

an outer supporting member (20), having a predetermined area, which is formed to include a shock absorbing space (10);

a cushion plate (30) which includes two bars (31,31') that are located at a predetermined interval inside from said outer supporting member (20) and connected to said outer supporting member (20) by a plurality of elastic springs (40), and a plurality of steel wires (32) that are installed at regular intervals between said two bars; and wherein said outer supporting member (20) comprises a first outer frame (21); a plurality of supporting frames (22), which are extended downwards from said first outer frame (21) to form said shock absorbing space (10); and a second outer frame (23), which is fixed to said supporting frames (22) and is in a parallel arrangement with said first outer frame (21), wherein said outer supporting member (20) further comprises a plurality of first reinforcing frames (24), being in a parallel arrangement to said steel wires (32) at regular intervals, which are fixed between said outer frames (21, 23) forming said shock absorbing space (10).

6. The device according to claim 5, wherein the bars are curved.

7. The device according to claim 5, wherein each of said steel wires has first and second end portions and each end portion has an end, said first end portion of each of said steel wires (32) on said cushion plate (30) is curved about a respective one of said bars (31) and the second end portion is curved about the second of said bars (31'), each end has a bend by which the end is fastened to its respective wire such that each steel wire is fastened to itself between the bars (31, 31'), said bars being arranged parallel to a longitudinal axis of the outer supporting member (20).

8. The device according to claim 7, wherein said cushion plate (30) further comprises a fixed member (35) to be placed between said steel wires (32) for preventing the movement of said steel wires (32).

9. A cushion device, the device comprising:

an outer supporting member (20), having a predetermined area, which is formed to include a shock absorbing space (10);

a cushion plate (30) which includes two bars (31,31') that are located at a predetermined interval inside from said outer supporting member (20) and connected to said outer supporting member (20) by a plurality of elastic springs (40), and a plurality of steel wires (32) that are installed at regular intervals between said two bars; and at least one elongated element (33), each elongated element (33) having two ends, the two ends being connected to said outer supporting member (20) by elastic springs (50), and each elongated element (33) being parallel to a longitudinal axis of the outer supporting member (20) and arranged transversely to said plurality of said steel wires (32) to support said steel wires wherein said outer supporting member (20) comprises a first outer frame (21); a plurality of supporting frames (22), which are extended downwards from said first outer frame (21) so as to form said shock absorbing space (10); and a second outer frame (23), which is fixed to said supporting frames (22) and is in a parallel arrangement with said first outer frame (21), wherein said outer supporting member (20) further comprises a plurality of first reinforcing frames (24), being in a parallel arrangement to said steel wires (32) at regular intervals, which are fixed between said outer frames (21, 23) forming said shock absorbing space (10), further comprising second reinforcing frames (25), which are in a parallel arrangement to said at least one elongated element (33) between said second outer frame (23) and said first reinforcing frames (24) adjacent to said second outer frame (23), in order to prevent flexing of said outer frames (21, 23) due to the tensility of said at least one elongated element (33).

10. A cushion device, the device comprising:

an outer supporting member (20), having a predetermined area, which is formed to include a shock absorbing space (10);

a cushion plate (30) which includes two bars (31,31') that are located at a predetermined interval inside from said outer supporting member (20) and connected to said outer supporting member (20) by a plurality of elastic springs (40), and a plurality of steel wires (32) that are installed at regular intervals between said two bars; and at least one elongated element (33), each elongated element (33) having two ends, the two ends being connected to said outer supporting member (20) by elastic springs (50), and each elongated element (33) being parallel to a longitudinal axis of the outer supporting member (20) and arranged transversely to said plurality of said steel wires (32) to support said steel wires (32), wherein the elongated element (33) is tied to the steel wires (32) by strings (34), said strings (34) made of material having an absence of metal.

11. The device according to claim 10, wherein said outer supporting member (20) comprises a first outer frame (21); a plurality of supporting flames (22), which are extended downwards from said first outer frame (21) so as to form said shock absorbing space (10); and a second outer flame (23), which is fixed to said supporting frames (22) and is in a parallel arrangement with said first outer frame (21).

12. The device according to claim 11, wherein said outer supporting member (20) further comprises a plurality of first reinforcing flames (24), being in a parallel arrangement to said steel wires (32) at regular intervals, which are fixed between said outer flames (21,23) forming said shock absorbing space (10).

13. The device according to claim 12, further comprising second reinforcing frames (25), which are in a parallel arrangement to said at least one elongated element (33) between said second outer frame (23) and said first reinforcing frames (24) adjacent to said second outer frame (23), in order to prevent flexing of said outer frames (21, 23) due to the tensity of said at least one elongated element (33).

14. The device according to claim 10, wherein the steel wires 32 are parallel to each other.

15. The device according to claim 10, said strings (34) being made of cotton yarn.

16. The device according to claim 10, wherein respective end portions of said steel wires (32) are curved about portions of said respective bars (31, 31') between two of said elastic springs (40) attached to said respective bars (31, 31'), said bars being parallel to a longitudinal axis of the outer supporting member (20).

17. The device according to claim 16, wherein each wire end portion has a bent end which is hooked, to the same steel wire (32) of which the bent end is a part, such that each steel wire 32 is hooked to itself (32) between the bars (31, 31').

18. The cushion device of claim 16, wherein the bars are curved.

19. The cushion device of claim 10, wherein each steel wire (32) is installed by having each said steel wire (32) fastened to itself between the bars (31, 31').

* * * * *